US008733113B2

(12) United States Patent
An et al.

(10) Patent No.: US 8,733,113 B2
(45) Date of Patent: May 27, 2014

(54) ICEMAKER AND REFRIGERATOR HAVING THE SAME

(75) Inventors: Jae Koog An, Gwangju (KR); Sung Cheol Kang, Gwangju (KR); Chang Uo Hong, Hwaseong-si (KR); Young Il Song, Gwangju (KR); Hae Ryong Jeon, Yeosu-si (KR); Se Woong Kim, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 62 days.

(21) Appl. No.: 13/350,282

(22) Filed: Jan. 13, 2012

(65) Prior Publication Data

US 2012/0180504 A1 Jul. 19, 2012

(30) Foreign Application Priority Data

Jan. 17, 2011 (KR) ..... 10-2011-0004384

(51) Int. Cl.

| | |
|---|---|
| ***F25C 5/02*** | (2006.01) |
| ***F25C 1/22*** | (2006.01) |
| ***F25C 5/18*** | (2006.01) |
| ***F25C 1/00*** | (2006.01) |

(52) U.S. Cl.

USPC ..... 62/71; 62/340; 62/344; 62/353

(58) Field of Classification Search

USPC ..... 62/66, 71, 72, 340, 344, 353, 354

See application file for complete search history.

(56) References Cited

U.S. PATENT DOCUMENTS

| | | | | |
|---|---|---|---|---|
| 2,878,659 | A * | 3/1959 | Waag et al. | 249/115 |
| 5,212,955 | A | 5/1993 | Hogan | |
| 5,718,121 | A | 2/1998 | Edwards et al. | |
| 6,112,540 | A | 9/2000 | Serrels et al. | |
| 6,901,764 | B2 * | 6/2005 | An et al. | 62/135 |
| 2006/0016209 | A1 | 1/2006 | Cole et al. | |
| 2007/0137241 | A1 | 6/2007 | Lee et al. | |
| 2007/0151282 | A1 * | 7/2007 | Jeong et al. | 62/349 |
| 2008/0295539 | A1 * | 12/2008 | An et al. | 62/407 |
| 2009/0019880 | A1 * | 1/2009 | Lee et al. | 62/345 |

FOREIGN PATENT DOCUMENTS

KR 1999-0049520 7/1999

OTHER PUBLICATIONS

Extended European Search Report dated Nov. 18, 2013 in European Patent Application No. 12150693.5.

* cited by examiner

*Primary Examiner* — Brandon M Rosati
*Assistant Examiner* — Elizabeth Martin
(74) *Attorney, Agent, or Firm* — Staas & Halsey LLP

(57) ABSTRACT

A refrigerator has an icemaker that includes a partition arm extending from the outside of the ice making tray into the ice making tray, the partition arm constituting a part of an ice compartment structure to define ice making cells. When the ice making tray is rotated in a given direction, the ice making tray allows ice to be separated from the ice making cells by being twisted by the partition arm. When the ice making tray is rotated in an opposite direction, the ice making tray allows the ice still present in the ice making cells to fall from the ice making cells by interference with a rotation stopper formed at the partition arm.

18 Claims, 12 Drawing Sheets

ICEMAKER AND REFRIGERATOR HAVING THE SAME

CROSS-REFERENCE TO RELATED APPLICATIONS

This application claims the priority benefit of Korean Patent Application No. 2011-0004384, filed on Jan. 17, 2011 in the Korean Intellectual Property Office, the disclosure of which is incorporated herein by reference.

BACKGROUND

1. Field

The following description relates to a refrigerator having an icemaker which exhibits an improved ice separating motion of an ice making unit.

2. Description of the Related Art

Generally, a refrigerator is an apparatus that stores food at a low temperature by supplying low-temperature air into a storage compartment in which the food is stored. The refrigerator includes a freezing compartment in which food is kept at or below a freezing temperature and a refrigerating compartment in which food is kept at a temperature slightly above freezing.

In recent years, a variety of large-scale refrigerators has been released to meet requirements of living convenience and storage spaces. Refrigerators are divided into, for example, ordinary refrigerators, dual door refrigerators, and combined refrigerators.

A refrigerator's door is provided with a dispenser that allows a user to discharge water or ice without opening the door, and an icemaker to supply ice into the dispenser is provided in a storage compartment.

The icemaker includes an ice making tray to make ice, and an ice bank in which the ice made in the ice making tray is stored. The ice made in the ice making tray is separated from the ice making tray by an ice separator and thereafter, is stored in the ice bank located below the ice making tray.

SUMMARY

Therefore, it is an aspect to provide a refrigerator having an icemaker which may achieve enhanced ice making efficiency and a simplified structure to separate ice from an ice making tray.

Additional aspects will be set forth in part in the description which follows and, in part, will be obvious from the description, or may be learned by practice of the invention.

In accordance with one aspect, a refrigerator includes a main body having a storage compartment, a door mounted to the main body to open or close the storage compartment, and an icemaker to make ice, wherein the icemaker includes an ice making tray having an ice making space, a plurality of partition arms extending from the outside of the ice making tray into the ice making tray and serving to divide the ice making space of the ice making tray so as to define a plurality of ice making cells, and a drive motor to rotate the ice making tray, and wherein when the ice making tray is rotated in a given direction by the drive motor, ice made in the ice making cells is primarily separated from the ice making tray as the ice making tray comes into contact with and is deformed by the plurality of partition arms, and when the ice making tray is rotated in an opposite direction by the drive motor, the ice still present in the ice making cells secondarily falls from the ice making tray by interference with the partition arms.

The ice making tray may include a plurality of ice compartment structures dividing the plurality of ice making cells arranged in a line, a plurality of divider walls may be provided on the bottom of the ice making tray to protrude upward at positions corresponding to the plurality of partition arms, and the plurality of ice compartment structures may be constituted by the plurality of divider walls and the plurality of partition arms.

The plurality of partition arms may be provided at distal portions thereof with rotation stoppers each extending toward the top of a neighboring one of the ice making cells, and the rotation stoppers may come into contact with the ice made in the ice making cells when the ice making tray is rotated in the opposite direction.

The ice making tray may be formed of stainless steel, and the divider walls may be formed at the bottom of the ice making tray by bending so as be integrally formed with the ice making tray.

The rotation stopper formed at any one of the plurality of partition arms may have a height difference with the rotation stopper formed at another one of the plurality of partition arms.

The refrigerator may further comprise an ice making unit supporter having a rotating shaft to rotatably support one end of the ice making tray, and the plurality of partition arms may extend from a vertical wall of the ice making tray supporter.

Each of the plurality of partition arms may include a fixing part secured to the vertical wall of the ice making unit supporter, an intervener part extending above an upper end of the ice making tray so as to come into contact with the upper end of the ice making tray when the ice making tray is rotated in the given direction, and a partition part extending along the corresponding divider wall from the intervener part.

A distal portion of the partition part may have a shape corresponding to the upper end of the divider wall so as not to interfere with the divider wall when the ice making tray is rotated in a direction causing the ice to fall.

The rotation stoppers may be formed respectively at opposite sides of an upper end of the distal portion of each partition part.

A distance between the intervener part and the upper end of the ice making tray may increase with decreasing distance from the drive motor.

In accordance with another aspect, a refrigerator includes an ice making unit mounted to a sidewall defining a storage compartment and serving to make ice, and an ice bank in which ice fallen from the ice making unit is stored, wherein the ice making unit includes an ice making unit supporter coupled to the sidewall of the storage compartment, an ice making tray in which a plurality of ice making cells as an ice making space is defined in a line by a plurality of divider walls protruding from the bottom of the ice making tray, a drive motor to rotate the ice making tray forward or in reverse, a plurality of partition arms extending from a sidewall of the ice making unit supporter toward corresponding upper ends of the plurality of divider walls and serving to divide the plurality of ice making cells in cooperation with the plurality of divider walls, and rotation stoppers each extending from a distal portion of each of the plurality of partition arms toward the top of a neighboring one of the respective ice making cells, and wherein when the ice making tray is rotated in a given direction by the drive motor, ice made in the ice making cells is primarily separated from the ice making tray as the ice making tray comes into contact with and is deformed by the plurality of partition arms, and when the ice making tray is rotated in an opposite direction by the drive motor, the ice still present in the ice making cells secondarily falls into the ice bank by interference with the rotation stoppers.

Each of the plurality of partition arms may include a fixing part secured to the ice making unit supporter, an intervener part placed above one edge of an upper end of the ice making tray so as to interfere with the ice making tray when the ice making tray is rotated in the given direction, and a partition part placed above the corresponding divider wall to constitute a part of an ice compartment structure that divides the plurality of ice making cells.

A distance between one intervener part and the upper end of the ice making tray may differ from a distance between another intervener part and the upper end of the ice making tray.

In accordance with a further aspect, an icemaker includes an ice making tray that is rotatable forward or in reverse by a drive motor and includes an ice compartment structure to define a plurality of ice making cells in a line, wherein the ice compartment structure includes a divider wall formed at the bottom of the ice making tray by bending and a partition arm extending from the outside of the ice making tray toward above the divider wall, wherein the partition arm includes an intervener part placed above one edge of an upper end of the ice making tray so as to interfere with the ice making tray when the ice making tray is rotated in a given direction, and a partition part placed above the divider wall to constitute a part of the ice compartment structure, and wherein the ice making tray is formed of a metal material to be twistable, and the divider wall is press-molded to have a predetermined curvature.

The partition part may be provided at a distal portion thereof with a rotation stopper that protrudes toward the top of a neighboring one of the ice making cells to restrict rotation of ice present in the ice making tray while the ice making tray is rotated in an opposite direction.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
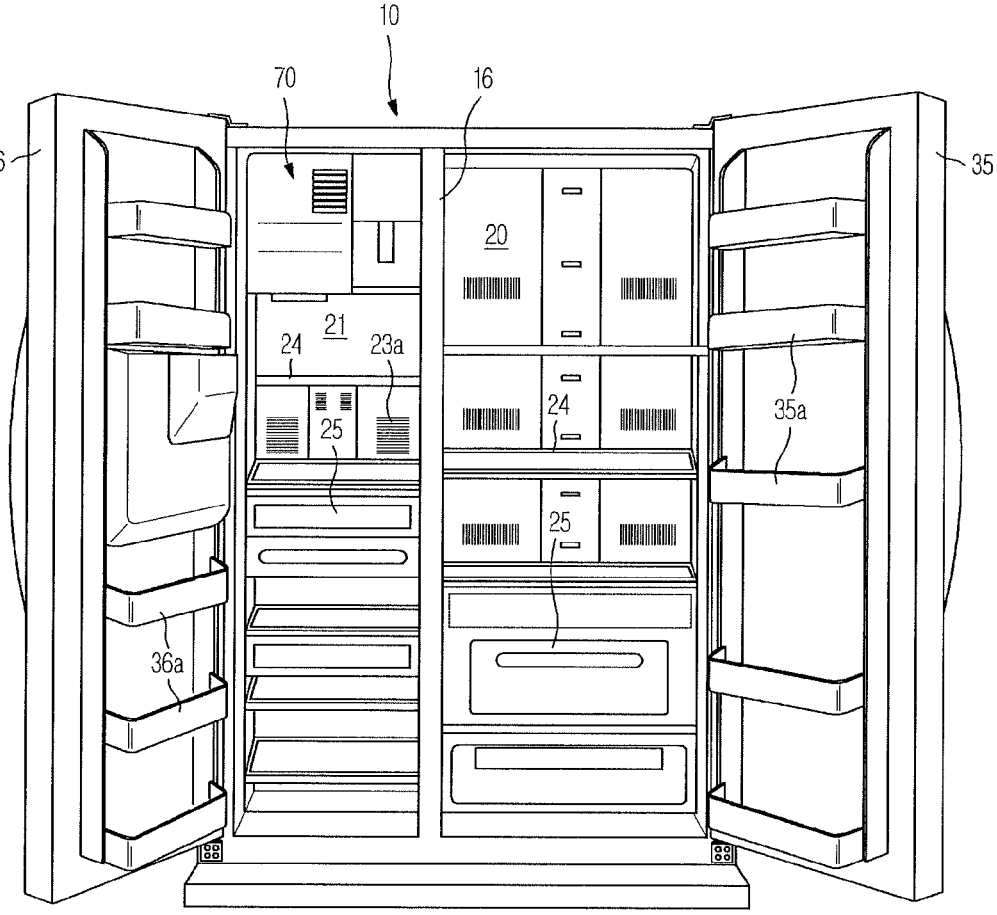
FIG. 1 is a view illustrating an internal configuration of a refrigerator according to an embodiment in a door open state.

Reference will now be made in detail to the embodiments, examples of which are illustrated in the accompanying drawings, wherein like reference numerals refer to like elements throughout.

Hereinafter, a refrigerator according to an exemplary embodiment will be described with reference to the accompanying drawings.

Figure 2:
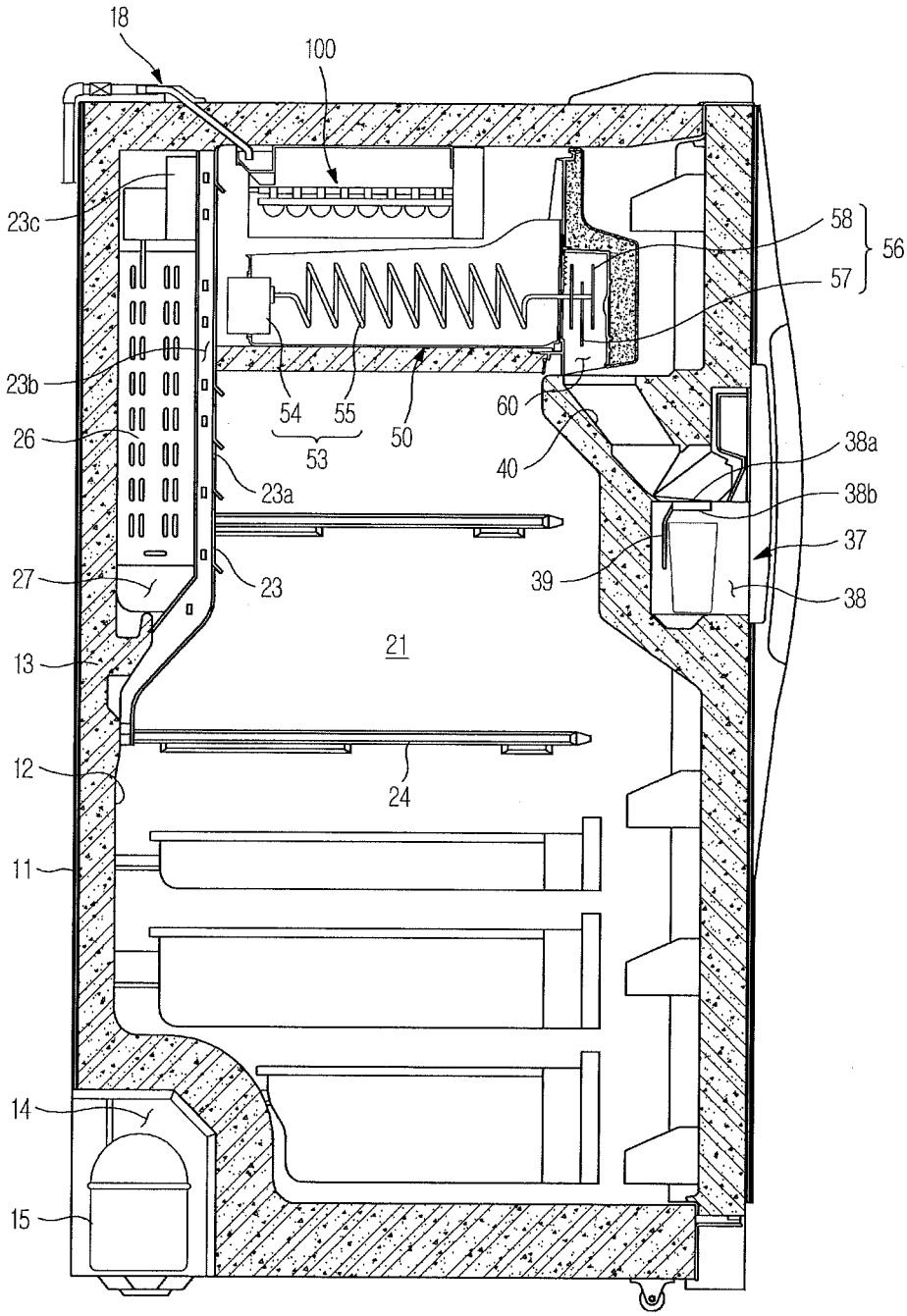
FIG. 2 is a sectional view of the refrigerator according to the embodiment.

FIG. 1 is a view illustrating an internal configuration of a refrigerator according to an embodiment in a door open state, and FIG. 2 is a sectional view of the refrigerator according to the embodiment.

Referring to FIGS. 1 and 2, the refrigerator of the embodiment may include a main body 10 defining the external appearance of the refrigerator, storage compartments 20 and 21 which are defined vertically lengthwise in the main body 10 and have open front sides, doors 35 and 36 to open or close the open front sides of the storage compartments 20 and 21, an icemaker 70 placed in one of the storage compartments 20 and 21, i.e. in a freezing compartment 21, and a dispenser 37 to discharge ice made in the icemaker 70 to a front surface of the door 36 of the freezing compartment 21.

An evaporator 26 to produce cold air is mounted to a rear wall of the main body 10. A machine room 14 is defined in a lower rear region of the main body 10. Foam 13 for thermal insulation is filled between an outer shell 11 and an inner shell 12 of the main body 10.

Electronic components, such as a compressor 15, etc., are installed in the machine room 14 defined in the main body 10. The storage compartments 20 and 21 are located above the machine room 14.

Although not shown, as a matter of course, the main body 10 contains other elements, such as a condenser and an expander constituting a refrigeration cycle, for example.

The storage compartments 20 and 21 are horizontally separated from each other by a vertical partition 16. The refrigerating compartment 20 is located at the right side of the drawing and may preserve food in a refrigerated stage, and the freezing compartment 21 is located at the left side of the drawing and may preserve food in a frozen stage.

An inner panel 23 is provided at rear ends of the storage compartments 20 and 21 and defines a cold air producing room 27 in which cold air to be supplied into the storage compartments 20 and 21 is produced. The evaporator 26 is located in the cold air producing room 27 to produce cold air by heat exchange with ambient air.

The inner panel 23 has a plurality of discharge slots 23*a* arranged at an interval to evenly disperse and discharge cold air into the storage compartments 20 and 21 and a cold air flow path 23*b* to guide the cold air to the discharge slots 23*a*. A circulating fan 23*c* is installed to blow the heat-exchanged cold air having passed through the evaporator 26 into the cold air flow path 23*b* and the discharge slots 23*a*.

Shelves 24 and storage boxes 25 for food storage are installed in the storage compartments 20 and 21.

A pair of the doors 35 and 36 is provided to open or close the refrigerating compartment 20 and the freezing compartment 21, respectively. The doors 35 and 36 include a refrigerating compartment door 35 rotatably coupled to the main body 10 to open or close the refrigerating compartment 20, and a freezing compartment door 36 rotatably coupled to the main body 10 to open or close the freezing compartment 21.

A plurality of door shelves 35*a* and 36*a* for food storage is attached to inner surfaces of the refrigerating compartment door 35 and freezing compartment door 36, respectively.

The dispenser 37 is provided at the freezing compartment door 36 and allows a user to discharge an object, such as water or ice, without opening the door 36. The icemaker 70 is located in an upper region of the freezing compartment 21 and serves to make ice and supply the same to the dispenser 37.

The icemaker 70 may include an ice making unit 100 to make ice by freezing water supplied by water supply device 18, and an ice bank 50 arranged below the ice making unit 100, in which ice separated from the ice making unit 100 is stored.

An ice transfer device 53 may be installed in the ice bank 50 to transfer the ice separated from the ice making unit 100 within the ice bank 50. A crushing room 60 may be provided in front of the ice bank 50 and an ice crusher 56 to selectively crush the ice transferred by the ice transfer device 53 may be installed in the crushing room 60.

The ice transfer device 53 may include a spiral auger 55 to transfer the ice stored in the ice bank 50 toward the crushing chamber 60 and a transfer motor 54 to rotate the spiral auger 55.

The ice crusher 56 includes a stationary blade 57 and a rotatable blade 58 installed on an end of the auger 55 and serves to produce cube ice or flake ice according to user selection.

The dispenser 37 includes a discharge chamber 38 indented inward from the front surface of the freezing compartment door 36 and having a discharge hole 38*a* for discharge of an object, an opening/closing member 38*b* to open or close the discharge hole 38*a*, an operating lever 39 provided in the discharge chamber 38 to operate the opening/closing member 38*b* and the icemaker 70 placed in the freezing compartment 21, and an ice discharge passage 40 extending from a rear surface to the front surface of the freezing compartment door 36 to guide ice from the icemaker 70 to the discharge hole 38*a*.

Hereinafter, the ice making unit according to the embodiment will be described in detail.

Figure 3:
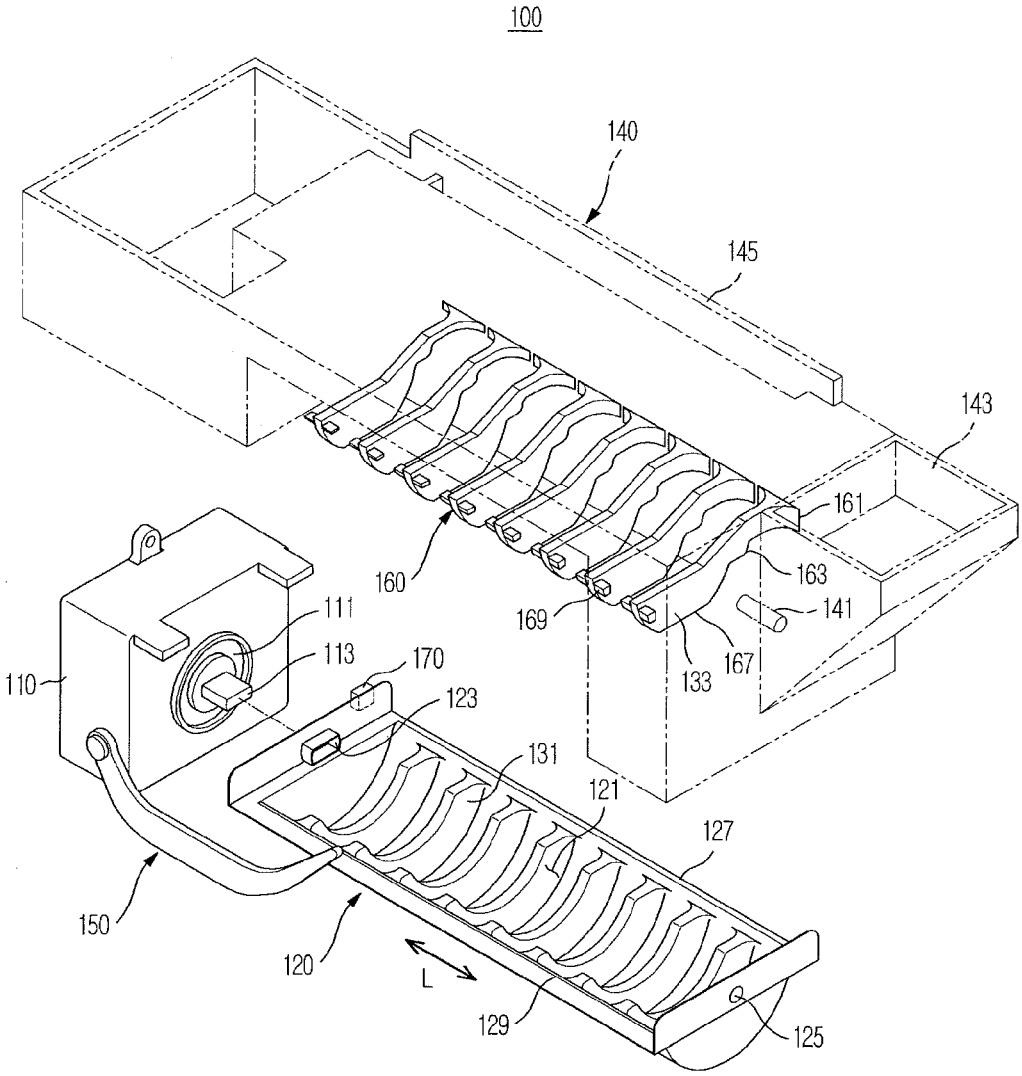
FIG. 3 is an exploded perspective view of an ice making unit according to the embodiment.
Figure 4:
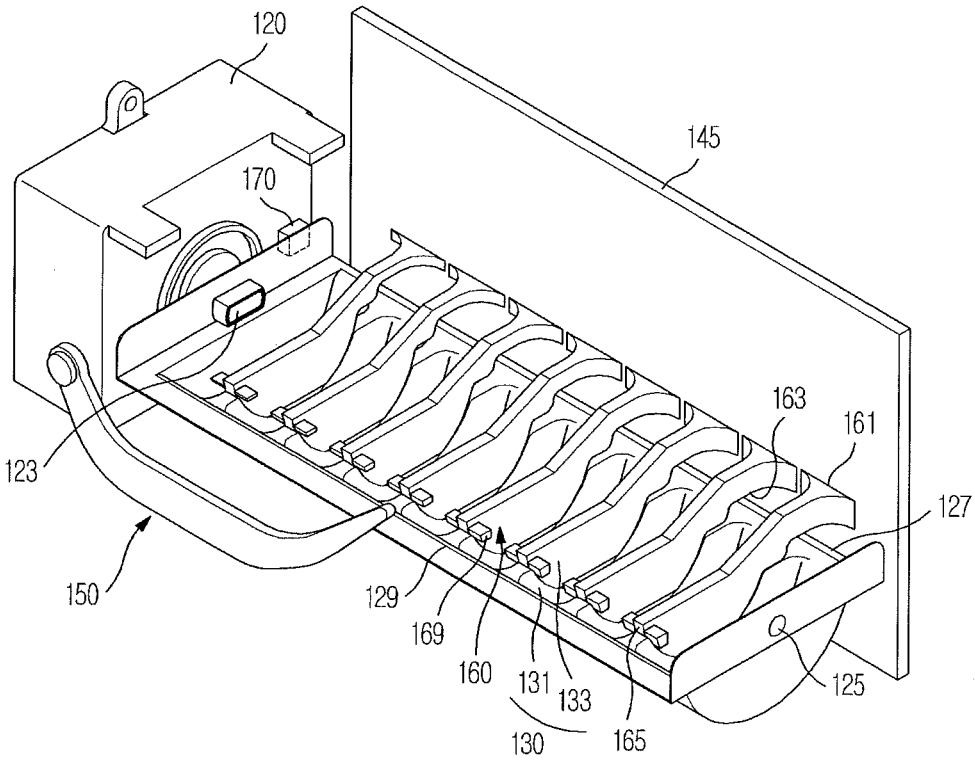
FIG. 4 is an assembled view of the ice making unit according to the embodiment.
Figure 5:
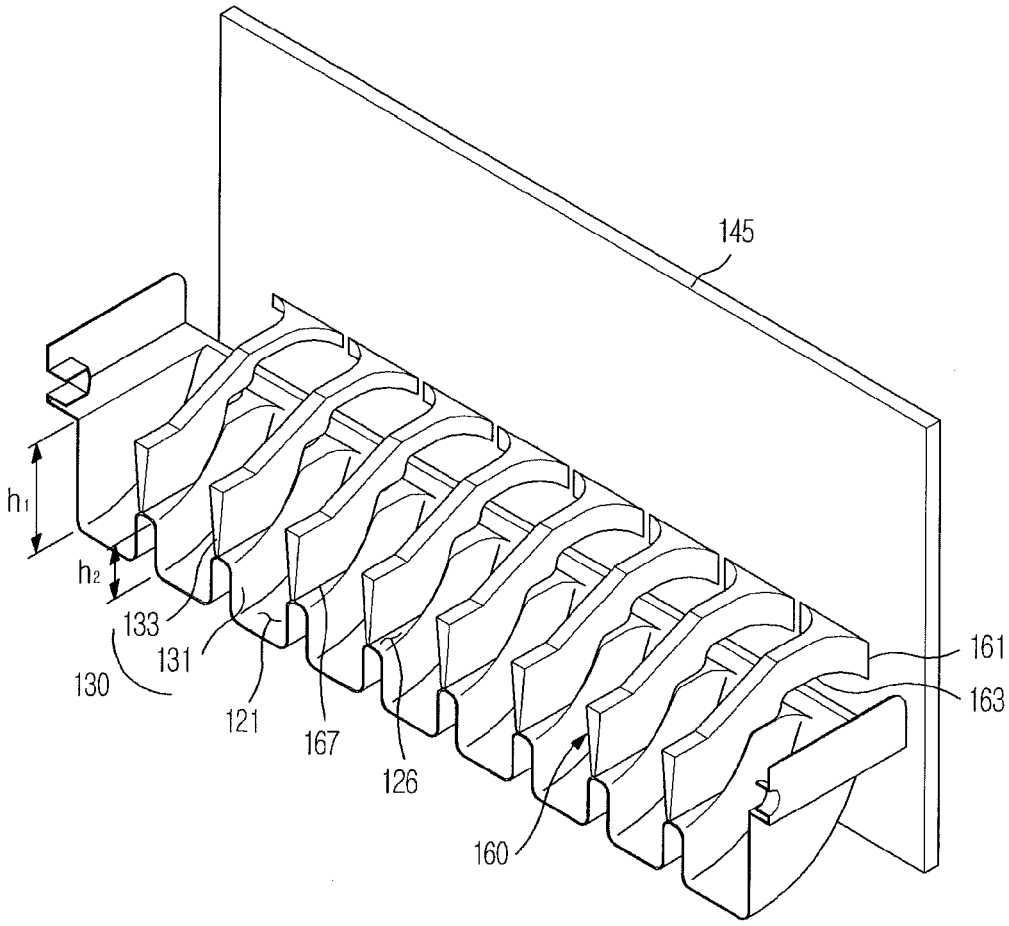
FIG. 5 is a partial cut-away view of the ice making unit according to the embodiment.

FIG. 3 is an exploded perspective view of the ice making unit according to the embodiment, FIG. 4 is an assembled view of the ice making unit according to the embodiment, and FIG. 5 is a partial cut-away view of the ice making unit according to the embodiment.

Referring to FIGS. 3 to 5, the ice making unit 100 of the embodiment may include an electronic element case 110 in which a variety of electronic elements is accommodated, an ice making tray 120 coupled to a rear surface of the electronic element case 110, and an ice making unit supporter 140 mounted to an inner surface of the storage compartment 21 so as to support both the electronic element case 110 and the ice making tray 120.

The electronic element case 110 accommodates a drive motor 111 to rotate the ice making tray 120 forward or in reverse and a variety of electronic elements and drive mechanisms to control operations of the ice making unit 100. The electronic elements and drive mechanisms may include a circuit board to control the drive motor 111 and a gear to reduce rotational force of the drive motor 111, for example.

An ice-full lever 150 to detect whether or not the ice bank 50 is full of ice may be connected to a lateral surface of the electronic element case 110. The ice-full lever 150 is configured to detect the fullness of ice via vertical movement thereof and transmit detected information to a controller (not shown) of the main body 10.

The ice making tray 120 is configured to receive water supplied by a water supply device 18 and freeze the water using cold air.

The ice making tray 120 is made of a metal material so as to be twistable and more particularly, may be press-molded using highly thermally conductive stainless steel (SUS). This provides the ice making tray 120 with a more simplified processing procedure as well as being thinner than a conventional aluminum tray prepared by die-casting, which is beneficial in view of transfer of cold air. Moreover, the ice making tray 120 has improved cold air transfer efficiency over an injection-molded tray, which may result in reduced ice making time.

The stainless steel ice making tray 120 is eco-friendly, unlike an aluminum ice making tray and does not need to be subjected to special coating, thus having cost benefits or energy saving effects.

The above-described stainless steel ice making tray 120 may include divider walls 131 to define a plurality of ice making cells 121 therein. The plurality of divider walls 131 may be spaced apart from one another by a constant distance in a longitudinal direction L of the ice making tray 120.

The divider walls 131 may be prepared by bending or be formed at the outside of the ice making tray 120 while the ice making tray 120 is being press-molded.

The divider walls 131, as illustrated in FIG. 5, may have a curved cross section having a predetermined curvature to obtain an increased transfer area of cold air. Additionally, the divider walls 131 may have a lower height h2 than a height h1 of the ice making cells 121.

The divider walls 131 as described above and partition arms 160 that will be described hereinafter together constitute ice compartment structures 130 to define the ice making cells 121.

The ice making cells 121 may be arranged in a line in the longitudinal direction L of the ice making tray 120 and may have a semicircular cross section.

A drive shaft coupler 123 is provided at a longitudinal end of the ice making tray 120 for coupling with a drive shaft 113 to which rotational force of the drive motor 111 is transmitted. An opposite longitudinal end of the ice making tray 120 is provided with a rotating shaft coupling hole 125 for coupling with a rotating shaft 141 of the ice making unit supporter 140.

The ice making tray 120 may be provided to be rotatable forward or in reverse by forward or reverse rotation of the drive motor 111.

The ice making tray 120, which is located adjacent to the drive motor 111, may be provided with a temperature sensor 170 to measure an internal temperature of the ice making tray 120.

The ice making unit supporter 140 may be secured to a sidewall of the storage compartment while supporting both the electronic element case 110 and the ice making tray 120.

The ice making unit supporter 140 may be shaped to encompass an upper and lateral portion of the ice making tray 120 and may include a water supply unit 143 provided at one side of an upper surface thereof to supply water into the ice making tray 120.

The ice making unit supporter 140 may include a vertical wall 145 vertically extending to encompass the lateral portion of the ice making tray 120. The vertical wall 145 may be located adjacent to one edge 127 of an upper end of the ice making tray 120.

The plurality of partition arms 160 may be formed at the vertical wall 145 so as to extend toward the ice making tray 120.

Each partition arm 160 and the corresponding divider wall 131 of the ice making tray 120 together constitute a part of the ice compartment structure 130 that defines the ice making cell 121.

More specifically, the partition arm 160 may include a fixing part 161 secured to the vertical wall 145, an intervener part 163 extending from the fixing part 161 toward the top of the ice making tray 120 to thereby be located above and near the edge 127 of the ice making tray 120, and a partition part 133 extending along an upper end of the divider wall 131 from the intervener part 163 so as to constitute the ice compartment structure 130 in cooperation with the divider wall 131.

When the ice making tray 120 is rotated counterclockwise by the drive motor 111, the intervener part 163 is brought into contact with the edge 127 of the ice making tray 120, thereby functioning to twist the ice making tray 120.

The intervener part 163 may be spaced upward from the edge 127 of the ice making tray 120 by a predetermined distance, so as to come into contact with the edge 127 after the ice making tray 120 has been rotated by a predetermined angle.

Figure 6:
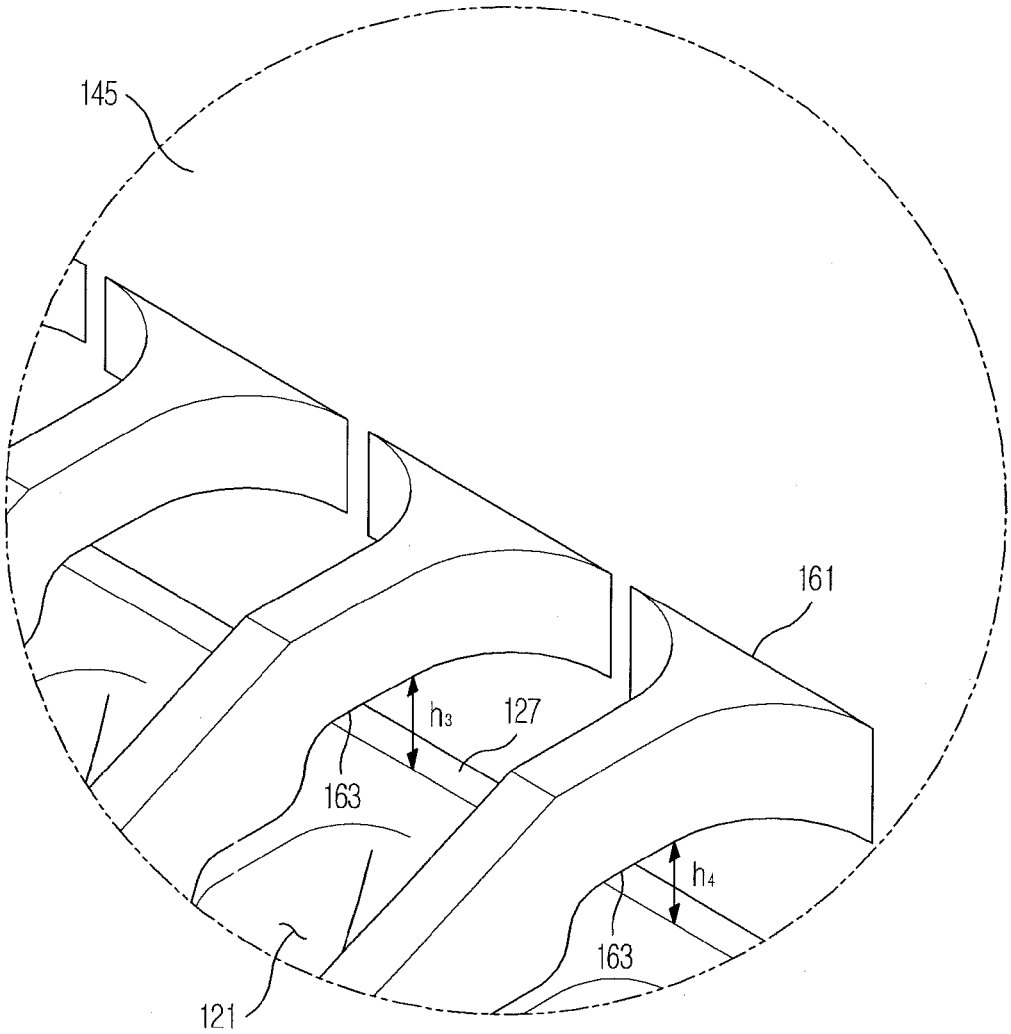
FIG. 6 is an enlarged view illustrating a relationship between an ice making tray and an intervener according to the embodiment.

As illustrated in FIG. 6, each intervener part 163 may be configured to have a predetermined height difference (h3<h4) with a next intervener part 163. This allows the edge 127 of the ice making tray 120 to sequentially come into contact with the respective intervener parts 163 in the longitudinal direction L, thereby being twisted when the ice making tray 120 is rotated by rotational force of the drive motor 111. As the ice making tray 120 is twisted, ice adhered to the ice making cells 121 is separated from the ice making cells 121. The height difference may be gradually increased with decreasing distance from the drive shaft 113.

The plurality of intervener parts 163, which respectively has a height difference from one another, may prevent overload due to idle rotation of the drive motor 111 temporarily caused when the ice making tray 120 is twisted by rotational force of the drive motor 111, thus functioning to prevent damage to the drive motor 111.

The partition part 133 may have a lower end located adjacent to the upper end of the divider wall 131, so as to constitute the ice compartment structure 130 defining the ice cell 121 in cooperation with the divider wall 131 of the ice making tray 120.

The partition part 133 may take the form of a plate that extends in parallel to the divider wall 131 and has a predetermined vertical length.

The lower end of the partition part 133 may be curved to correspond to the divider wall 131 of the ice making tray 120 and may be provided at the center thereof with a horizontal notch 167.

With this configuration, a water passage 126 may be formed between the horizontal notch 167 formed at the lower end of the partition part 133 and the upper end of the divider wall 131. The water passage 126 functions to introduce water supplied into any one of the ice making cells 121 into other neighboring ice making cells 121.

A distal end 165 of the partition part 133 is configured so as not to interfere with a surrounding area of an opposite edge 129 of the upper end of the ice making tray 120 when the ice making tray 120 is rotated clockwise. Rotation stoppers 169 may be provided at opposite sides of the distal end 165 and be configured to extend above the ice making cells 121.

The rotation stoppers 169 may function to restrict ice made in the ice making cells 121 from being rotated along with the ice making tray 120 when the ice making tray 120 is rotated clockwise.

Figure 7:
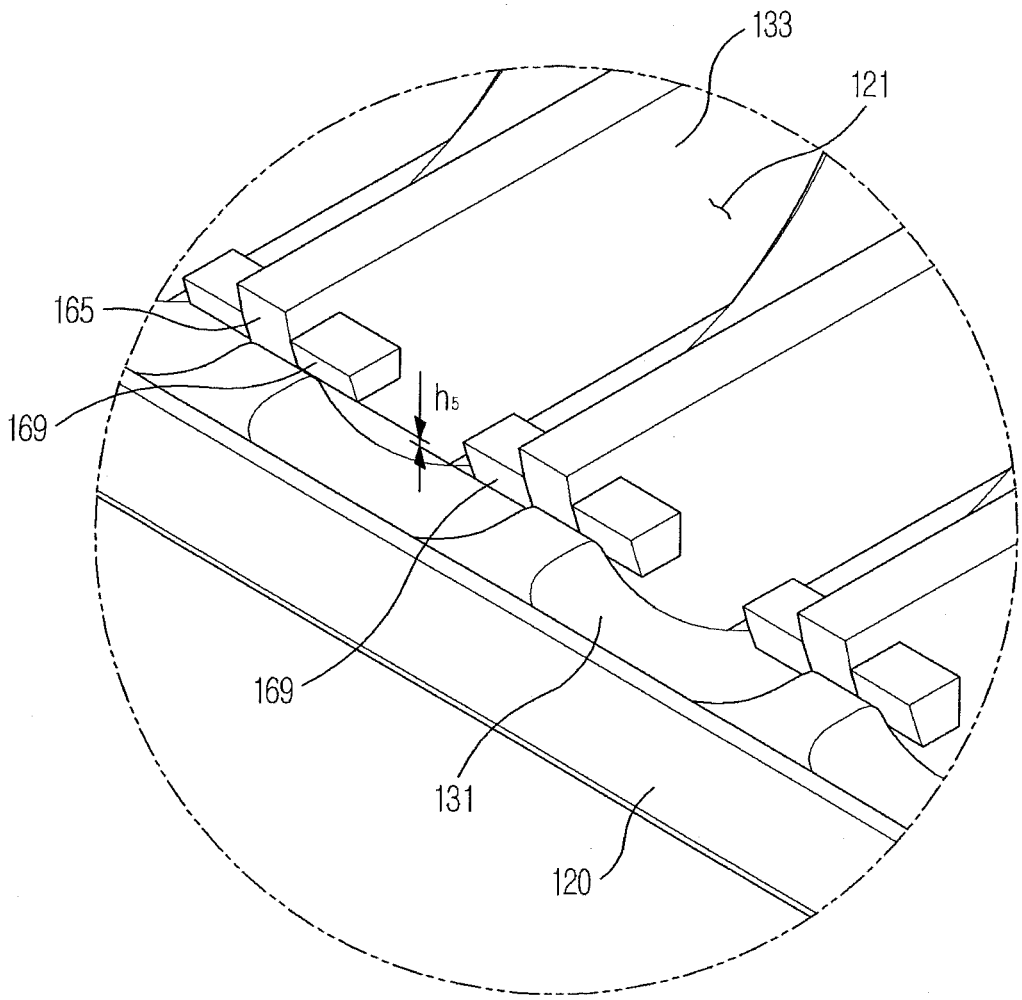
FIG. 7 is an enlarged view illustrating a relationship between the ice making tray and a rotation stopper according to the embodiment.

The respective neighboring rotation stoppers 169 may have a height difference from one another. More specifically, as illustrated in FIG. 7, the rotation stoppers 169 may be formed at the respective partition parts 133 in such a way that the lower end of any one rotation stopper 169 has a height difference h5 with the lower end of another neighboring rotation stopper 169.

With this configuration, when the ice making tray 120 is rotated clockwise, ice made in the plurality of ice making cells 121 sequentially interferes with the rotation stoppers 169 of the respective partition parts 133 at a certain frequency, which prevents overload of the drive motor 111 caused when all the rotation stoppers 169 simultaneously interfere with the ice in the respective ice making cells 121, thereby guaranteeing smooth separation of the ice from the ice making tray 120.

The height difference h5 between the rotation stoppers 169 may have random values or may have sequential values.

Hereinafter, operation of the ice making unit according to the embodiment will be described. FIGS. 8A to 8F are views illustrating an ice separating operation of the ice making tray according to the embodiment.

First, water is supplied into any one of the ice making cells 121 of the ice making tray 120 and is introduced into another neighboring ice making cell 121 through the water passage 126 until all the respective ice making cells 121 are full of water while the ice making tray 120 is cooled by cold air. Thereafter, the temperature sensor 170 attached to one side of the ice making tray 120 detects a temperature of the ice making tray 120. The controller determines that the water is completely frozen to make ice if the temperature of the ice making tray 120 reaches a preset temperature, thereby controlling the drive motor 111 to rotate the ice making tray 120 so as to separate the ice from the ice making tray 120.

Figure 8A:
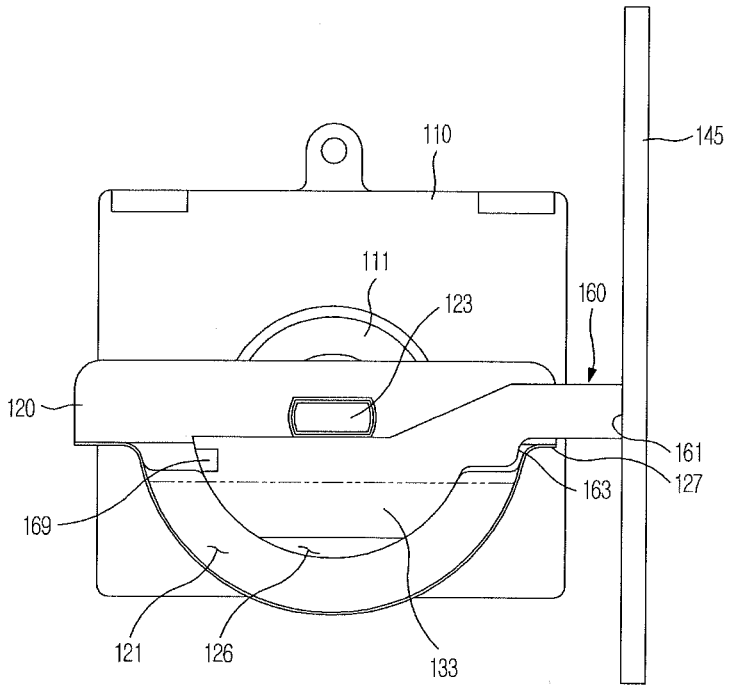
FIGS. 8A to 8E are views illustrating an operation of the ice making unit according to the embodiment.
Figure 8B:
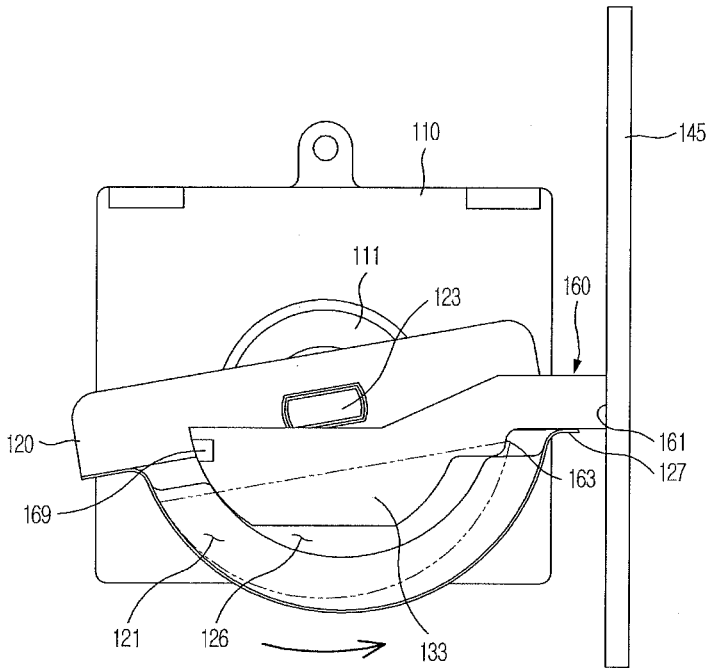

This state in which the ice is completely made in the ice making cells 121 of the ice making tray 120 is as illustrated in FIG. 8A. Thereafter, if the drive motor 111 is rotated counterclockwise by a predetermined angle, the ice making tray 120 coupled to the drive shaft 113 of the drive motor 111 is also rotated counterclockwise as illustrated in FIG. 8B.

If the ice making tray 120 is rotated, the edge 127 of the ice making tray 120 interferes with the intervener parts 163 of the partition arms 160, causing the ice making tray 120 to be twisted. In this way, the ice adhered to the ice making cells 121 is separated from the ice making cells 121. The rotation angle of the drive motor 111 may be within approximately 10 degrees. Additionally, because the respective intervener parts 163 of the plurality of partition arms 160, which are spaced apart from one another in a line, have different heights that gradually increase with decreasing distance from the drive shaft 113, the ice making tray 120 is sequentially twisted at a certain frequency, preventing overload of the drive motor 111 during twisting and ensuring smooth separation of the ice from the ice making cells 121.

Figure 8C:
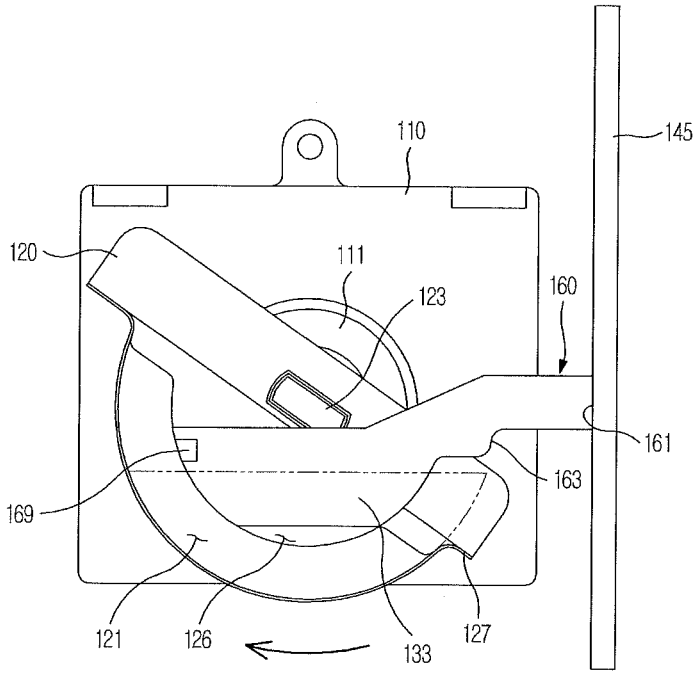
Figure 8D:
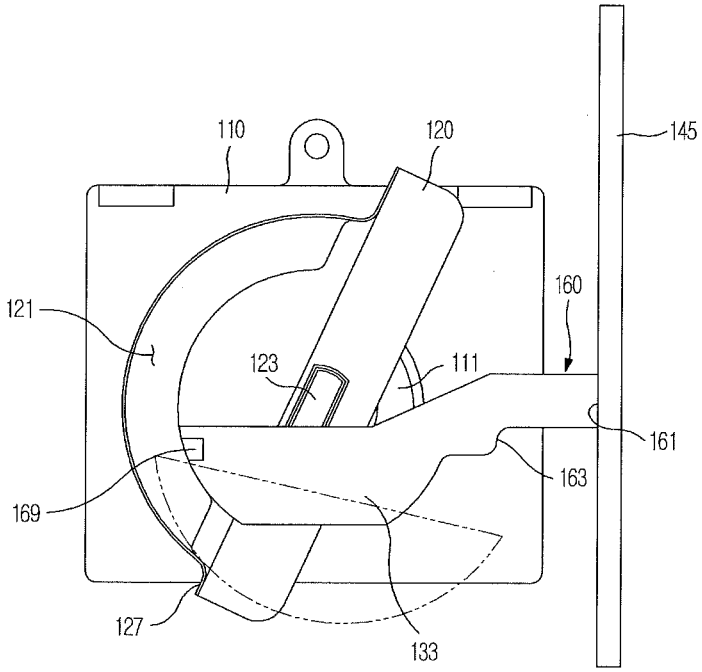

Thereafter, if the drive motor 111 is rotated clockwise, the ice making tray 120 is rotated clockwise as illustrated in FIG. 8C and the ice separated from the ice making cells 121 of the twisted ice making tray 120 is moved relative to the ice making cells 121. In the meantime, some ice fails to be separated from the ice making cells 121 after the ice making tray 120 has been twisted. Although the un-separated ice is rotated along with the ice making tray 120, the rotation stoppers 169 formed at the partition arms 160 act to obstruct upward rotation of the ice present in the ice making cells 121 by coming into contact with the top of the ice.

Figure 8E:
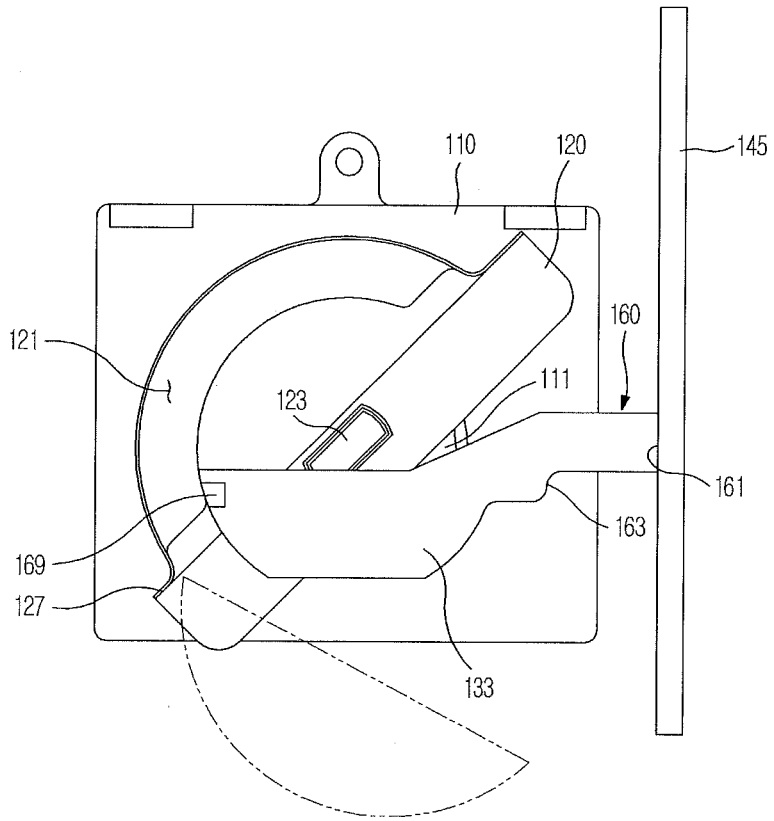

This causes the ice adhered to the ice making cells 121 to be separated. Then, if the ice making tray 120 is further rotated clockwise by a predetermined angle, as illustrated in FIG. 8E, the ice falls from the ice making tray 120 as the center of gravity of the ice escapes from the ice making cell 121.

Thereafter, the ice making tray 120 is returned to an original position thereof to prepare for a new ice making operation.

With the above described configuration, the ice making unit 100 of the embodiment may efficiently perform an ice separating operation even without an ice separator, such as an ejector or a heater, to assist in separating ice, which results in improved workability and consequently, productivity owing to a reduced number of ice separating elements.

As is apparent from the above description, a refrigerator having an icemaker according to the embodiment may ensure efficient separation of ice from an ice making tray with a simplified configuration as well as enhanced ice making efficiency.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment;

a door mounted to the main body to open or close the storage compartment; and an icemaker to make ice, wherein the icemaker includes:

an ice making tray having an ice making space;

a plurality of partition arms extending from the outside of the ice making tray into the ice making tray, dividing the ice making space of the ice making tray and defining a plurality of ice making cells; and a drive motor to rotate the ice making tray, and wherein when the ice making tray is rotated in a given direction by the drive motor, ice made in the ice making cells is primarily separated from the ice making tray as the ice making tray comes into contact with and is deformed by the plurality of partition arms, and wherein when the ice making tray is rotated in an opposite direction by the drive motor, the ice still present in the ice making cells secondarily falls from the ice making tray by interference with the partition arms.

2. The refrigerator according to claim 1, wherein the ice making tray includes a plurality of ice compartment structures dividing the plurality of ice making cells arranged in a line, wherein a plurality of divider walls is provided on the bottom of the ice making tray to protrude upward at positions corresponding to the plurality of partition arms, and wherein the plurality of ice compartment structures is constituted by the plurality of divider walls and the plurality of partition arms.

3. The refrigerator according to claim 1, wherein the plurality of partition arms is provided with rotation stoppers at distal portions thereof each extending toward the top of a neighboring one of the ice making cells, and wherein the rotation stoppers come into contact with the ice made in the ice making cells when the ice making tray is rotated in the opposite direction.

4. The refrigerator according to claim 2, wherein the ice making tray is formed of stainless steel, and the divider walls are formed at the bottom of the ice making tray by bending to be integrally formed with the ice making tray.

5. The refrigerator according to claim 3, wherein the rotation stopper formed at any one of the plurality of partition arms has a height difference with the rotation stopper formed at another one of the plurality of partition arms.

6. The refrigerator according to claim 2, further comprising an ice making unit supporter having a rotating shaft to rotatably support one end of the ice making tray, wherein the plurality of partition arms extends from a vertical wall of the ice making tray supporter.

7. The refrigerator according to claim 6, wherein each of the plurality of partition arms includes a fixing part secured to the vertical wall of the ice making unit supporter, an intervener part extending above an upper end of the ice making tray so as to come into contact with the upper end of the ice making tray when the ice making tray is rotated in the given direction, and a partition part extending along the corresponding divider wall from the intervener part.

8. The refrigerator according to claim 7, wherein a distal portion of the partition part has a shape corresponding to the upper end of the divider wall so as not to interfere with the divider wall when the ice making tray is rotated in a direction causing the ice to fall.

9. The refrigerator according to claim 8, wherein the rotation stoppers are formed respectively at opposite sides of an upper end of the distal portion of each partition part.

10. The refrigerator according to claim 7, wherein a distance between the intervener part and the upper end of the ice making tray increases with decreasing distance from the drive motor.

11. A refrigerator comprising:

an ice making unit mounted to a sidewall defining a storage compartment and serving to make ice; and an ice bank in which ice fallen from the ice making unit is stored, wherein the ice making unit includes:

an ice making unit supporter coupled to the sidewall of the storage compartment;

an ice making tray in which a plurality of ice making cells as an ice making space is defined in a line by a plurality of divider walls protruding from the bottom of the ice making tray;

a drive motor to rotate the ice making tray forward or in reverse;

a plurality of partition arms extending from a sidewall of the ice making unit supporter toward corresponding upper ends of the plurality of divider walls, dividing and defining the plurality of ice making cells in cooperation with the plurality of divider walls; and rotation stoppers each extending from a distal portion of each of the plurality of partition arms toward the top of a neighboring one of the respective ice making cells, wherein when the ice making tray is rotated in a given direction by the drive motor, ice made in the ice making cells is primarily separated from the ice making tray as the ice making tray comes into contact with and is deformed by the plurality of partition arms, and wherein when the ice making tray is rotated in an opposite direction by the drive motor, the ice still present in the ice making cells secondarily falls into the ice bank by interference with the rotation stoppers.

12. The refrigerator according to claim 11, wherein each of the plurality of partition arms includes a fixing part secured to the ice making unit supporter, an intervener part placed above one edge of an upper end of the ice making tray so as to interfere with the ice making tray when the ice making tray is rotated in the given direction, and a partition part placed above the corresponding divider wall to constitute a part of an ice compartment structure that divides the plurality of ice making cells.

13. The refrigerator according to claim 12, wherein a distance between one intervener part and the upper end of the ice making tray differs from a distance between another intervener part and the upper end of the ice making tray.

14. An icemaker comprising an ice making tray that is rotatable forward or in reverse by a drive motor and includes an ice compartment structure to define a plurality of ice making cells in a line, wherein the ice compartment structure includes a divider wall formed at the bottom of the ice making tray by bending and a partition arm extending from the outside of the ice making tray toward above the divider wall, wherein the partition arm includes an intervener part placed above one edge of an upper end of the ice making tray, interfering with the ice making tray when the ice making tray is rotated in a given direction, and a partition part placed above the divider wall constituting a part of the ice compartment structure, and wherein the ice making tray is formed of a metal material to be twistable, and the divider wall is press-molded to have a predetermined curvature.

15. The icemaker according to claim 14, wherein the partition part is provided with a rotation stopper at a distal portion thereof that protrudes toward the top of a neighboring one of the ice making cells to restrict rotation of ice present in the ice making tray while the ice making tray is rotated in an opposite direction.

16. A method of separating ice from an ice making tray, the method comprising:

freezing water in an ice making tray in which a plurality of partition arms extend from the outside of the ice making tray into the ice making tray, dividing the ice making space of the ice making tray and defining a plurality of ice making cells;

rotating the ice making tray in a first direction by a drive motor such that ice made in the ice making cells is primarily separated from the ice making tray as the ice making tray comes into contact with and is deformed by the plurality of partition arms; and rotating the ice making tray in a second direction opposite to the first direction by the drive motor such that the ice still present in the ice making cells secondarily falls from the ice making tray by interference with the partition arms.

17. The method of separating ice from an ice making tray of claim 16, wherein the ice making tray is twisted when the ice making tray is rotated in the first direction and comes into contact with the plurality of partition arms.

18. The method of separating ice from an ice making tray of claim 16, wherein ice still present in the ice making cells comes into contact with the partition arms sequentially during the rotation of the ice making tray in the second direction.

* * * * *

UNITED STATES PATENT AND TRADEMARK OFFICE

CERTIFICATE OF CORRECTION

PATENT NO. : 8,733,113 B2
APPLICATION NO. : 13/350282
DATED : May 27, 2014
INVENTOR(S) : An et al.

It is certified that error appears in the above-identified patent and that said Letters Patent is hereby corrected as shown below:

In the Claims

Column 10, Line 52, in Claim 12, after “tray” delete “so as”.

Signed and Sealed this
Nineteenth Day of August, 2014

Michelle K. Lee

Michelle K. Lee
*Deputy Director of the United States Patent and Trademark Office*